US006564456B2

(12) United States Patent
Goldau et al.

(10) Patent No.: US 6,564,456 B2
(45) Date of Patent: May 20, 2003

(54) METHOD OF FINISHING A VALVE SEAT FOR BALL VALVES, IN PARTICULAR FOR FUEL INJECTION VALVES IN INTERNAL COMBUSTION ENGINES

(75) Inventors: Harald Goldau, Klein-Gübs (DE); Marc Stephan Klopp, Radevormwald (DE); Martin Wolters, Wuppertal (DE)

(73) Assignee: Ernst Thielenhaus GmbH & Co. KG, Wuppertal (DE)

( * ) Notice: Subject to any disclaimer, the term of this patent is extended or adjusted under 35 U.S.C. 154(b) by 46 days.

(21) Appl. No.: 09/883,436

(22) Filed: Jun. 18, 2001

(65) Prior Publication Data

US 2002/0040523 A1 Apr. 11, 2002

(30) Foreign Application Priority Data

Jun. 20, 2000 (DE) ..... 100 29 322

(51) Int. Cl.[7] ..... B23P 15/00

(52) U.S. Cl. ..... 29/888.44; 29/890.122; 29/558

(58) Field of Search ..... 29/888.44, 890.122, 29/557, 558; 451/51, 57

(56) References Cited

U.S. PATENT DOCUMENTS 4,999,911 A * 3/1991 Anderson ..... 123/188.2
5,745,993 A * 5/1998 Adachi et al. ..... 29/888.44
5,810,647 A * 9/1998 Rogers ..... 451/285
5,933,296 A * 8/1999 Kang ..... 360/291.2
6,035,532 A * 3/2000 Earnhardt ..... 29/888.44
6,173,494 B1 * 1/2001 Becker ..... 29/890.044
6,354,001 B1 * 3/2002 Asanuma ..... 29/888.4

FOREIGN PATENT DOCUMENTS

EP 0 955 128 5/1998

* cited by examiner

*Primary Examiner*—I. Cuda-Rosenbaum
(74) *Attorney, Agent, or Firm*—Collard & Roe, P.C.

(57) ABSTRACT

A method for finishing a valve seat for ball valves, in particular for fuel injection valves in internal combustion engines. The workpiece to be finished and a finishing tool are driven in an opposite direction of rotation, whereby the axes of rotation of the workpiece and the finishing tool are aligned with each other at an angle of from 1° to 10°. The finishing tool rests against the inside surface of the workpiece to be finished over its entire circumference. The surface of the workpiece to be treated is provided with a crowned shape. A finishing stone with a wear-resistant and preferably cone-shaped working surface is employed as the finishing tool, whereby a narrow sealing zone with a convex contour in the longitudinal section is produced in the crowned surface of the workpiece by partial removal of material.

7 Claims, 8 Drawing Sheets

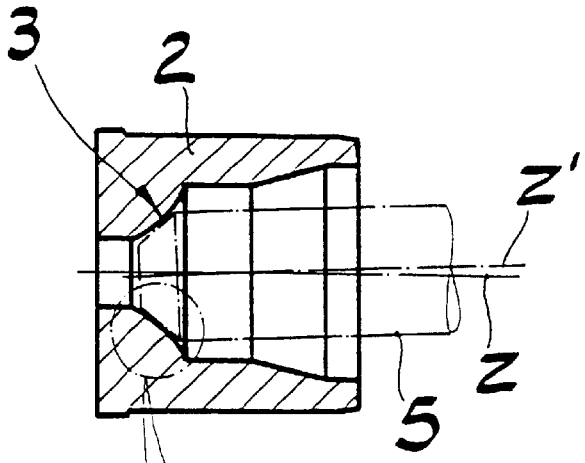
Fig.3b
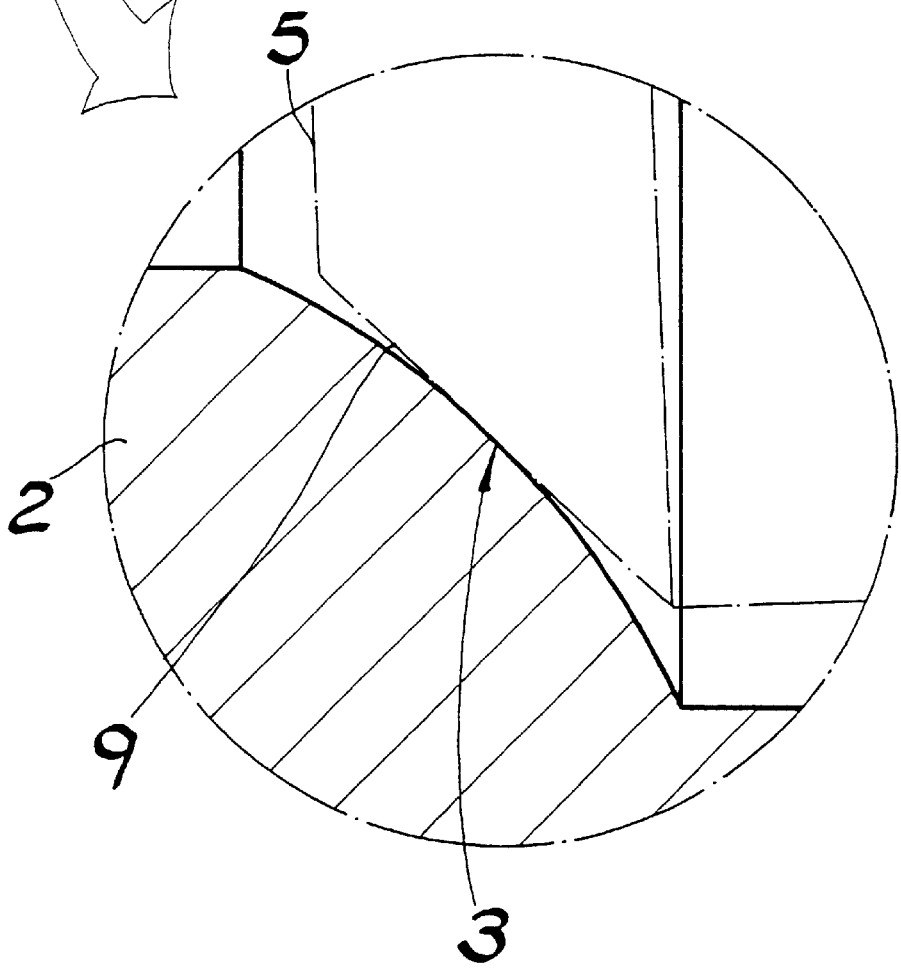

METHOD OF FINISHING A VALVE SEAT FOR BALL VALVES, IN PARTICULAR FOR FUEL INJECTION VALVES IN INTERNAL COMBUSTION ENGINES

CROSS-REFERENCE TO RELATED APPLICATIONS

Applicants claim priority under 35 U.S.C. § 119 of German Application No. 100 29 322.0 filed Jun. 20, 2000.

BACKGROUND OF THE INVENTION

1. Field of the Invention

This invention relates to a method for finishing a valve seat for ball valves, in particular for fuel injection valves in internal combustion engines. In this invention, the workpiece to be finished and a finishing tool are preferably driven to rotate in an opposite direction. The axes of rotation of the workpiece and the finishing tool are aligned at an angle of from 1° to 10° in relation to each other, and whereby the finishing tool is applied to the entire circumference of the internal surface of the workpiece to be finished.

2. The Prior Art

A method with the feature described in part above is known from European patent EP 0 955 128 A2. The finishing tool consists of a cylindrical finishing stone. A seating surface with a circular shape viewed in the longitudinal section and extending circumferentially in the form of a ring, is worked into a conical valve seat by the known method. By means of the finishing treatment, it is possible to eliminate deviations in the shape measured in the cross section. Sealing systems with valve seats that have been finished according to the known method have a very good seat of the valve between the ball of the valve and the surface of the seat. However, when the cup-shaped surface of the seat is produced in the conical valve seat, a close inspection of the very short distances within which the ball of the valve is set in the course of the opening process shows that the through-flow characteristic of the valve changes. The gap between the cup-shaped seat surface and the ball of the valve, has a higher pressure loss than the gap between a conical surface and the ball of the valve of this gap, due to the short setting path of the valve ball. When the valve ball lifts off from the valve seat, this consequently results in a nonlinear characteristic, which is troublesome with very small valves, such as, for example, fuel injection valves. Another drawback is that when the ball valve opens, high adhesive forces acting between the valve ball and the cup-shaped surface of the valve seat have to be overcome.

SUMMARY OF THE INVENTION

The present invention provides a method of further developing the finishing treatment of the valve seat for ball valves so that the finished valve seat exhibits more favorable properties. A sealing system comprised of a valve ball and a finished valve seat is expected to open when low force is applied, and, when the ball lifts off from the valve seat, a large annular gap is immediately released, with low loss of pressure. Furthermore, it must be assured that the valve ball is seated on the valve seat as tightly as possible.

According to the method of the invention, the surface of the workpiece to be finished is provided with a crowned shape. Moreover, a finishing stone with a treatment surface that is resistant to wear is employed, to produce a narrow sealing zone with a convex contour in the longitudinal section, in the crowned surface of the workpiece, by partially removing some material. A finishing tool having a cone-shaped working surface is preferably used. Finishing the surface of the workpiece with a crowned shape thus permits the axis of rotation of the cone-shape finishing stone to be aligned at an angle in relation to the axis of rotation of the workpiece. The cone-shaped surface of the finishing tool applied to the inner surface of the workpiece is then finished over its entire circumference. By means of the finishing treatment as defined by the invention, a sealing zone is worked into the crowned surface of the workpiece that has a relatively narrow width, and is limited to the area where the ball and the seat of the valve are in direct contact. The width of the sealing zone usually amounts to a few tenths of one millimeter. Dimensional deviations from the circular shape originally present on the surface of the workpiece are nearly completely eliminated within the area of the sealing zone. Any dimensional deviations from the circular shape measured in the cross section can be reduced to less than 0.1 micrometer. The result is a sealing seat between the valve ball and the sealing zone that has a very low rate of leakage. Owing to the crowned, convex shape of the sealing zone, an annular gap with low loss of flow is released when the valve ball lifts off from the valve seat.

The valve seat to be finished may have a crowned surface of the sealing section, or may be provided with a crowned shape over its entire length measured in the direction of flow. In the embodiment first described above, the crowned surface of the workpiece to be finished forms an inwardly projecting section within a conical valve seat. In another embodiment, the crowned surface of the workpiece serving as the valve seat, limits the tapered space for receiving a valve ball, and connects two cylindrical sections of the workpiece that have different diameters.

The finishing stone or the workpiece is usefully inserted in a holding means that compensates for errors in the alignment between the workpiece and the finishing stone. The holding means is preferably a shaft made of hard rubber.

According to a further embodiment of the invention, a seating surface extending in the form of a circumferential ring and having a circular shape in the longitudinal section is worked into the already-finished sealing zone having a convex curvature. The sealing seat for a valve ball can thus be enhanced further in this way. However, as compared to the prior art of EP 0 955 128 A2, the cup-shaped deepening of the seating surface is substantially smaller because no dimensional deviations have to be compensated for as the deepening is produced in the form of a spherical indentation. An improved sealing seat can be obtained to that extent, without affecting the through-flow characteristic of the valve in any adverse way. In the finishing treatment of the sealing seat, the workpiece and a cylindrical finishing stone are driven in an opposite direction of rotation, whereby the axes of rotation of the workpiece and the finishing stone are aligned with each other at an angle of from 1° to 10°, and the finishing stone rests against the entire circumference of the sealing zone. The area of contact of the cylindrical finishing stone on the surface side is usefully rounded in the form of a spherical indentation.

BRIEF DESCRIPTION OF THE DRAWINGS

Other objects and features of the present invention will become apparent from the following detailed description considered in connection with the accompanying drawings. It should be understood, however, that the drawings are designed for the purpose of illustration only and not as a definition of the limits of the invention.

FIGS. 3*a* to 3*c* show the sequence of the steps of a method as defined by the invention for the finishing treatment of the valve seat.

DETAILED DESCRIPTION OF THE PREFERRED EMBODIMENT

Figure 1:
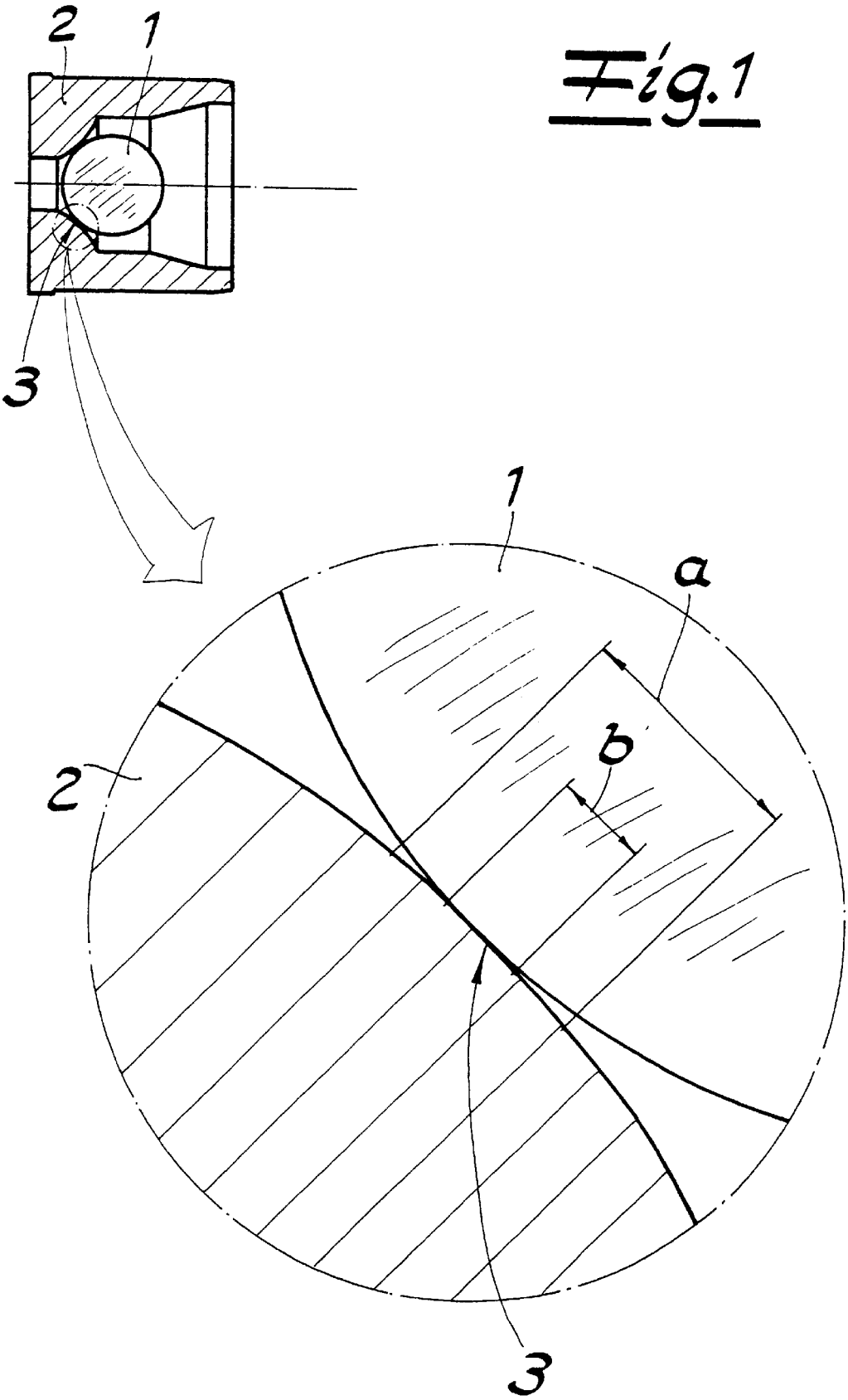
FIG. 1 is a longitudinal section through a sealing system for a ball valve that may be employed, as a fuel injection valve in internal combustion engines.

The sealing system shown in FIG. 1 is comprised of a valve ball 1 and a valve body 2, which has a valve seat 3 for ball 1, having the size of a few millimeters. Valve seat 3 is provided with a crowned shape. A narrow sealing zone "a" having a convex contour in the longitudinal section, is worked into the crowned surface of the workpiece by means of a finishing treatment as explained in the following. The width of sealing zone " " amounts to a few tenths of one millimeter. Sealing zone "a" contains a seating surface "b" forming a sealing seat for valve ball 1, the seating surface extending circumferentially in the form of a ring, and having a circular shape in the longitudinal section.

Figure 2:
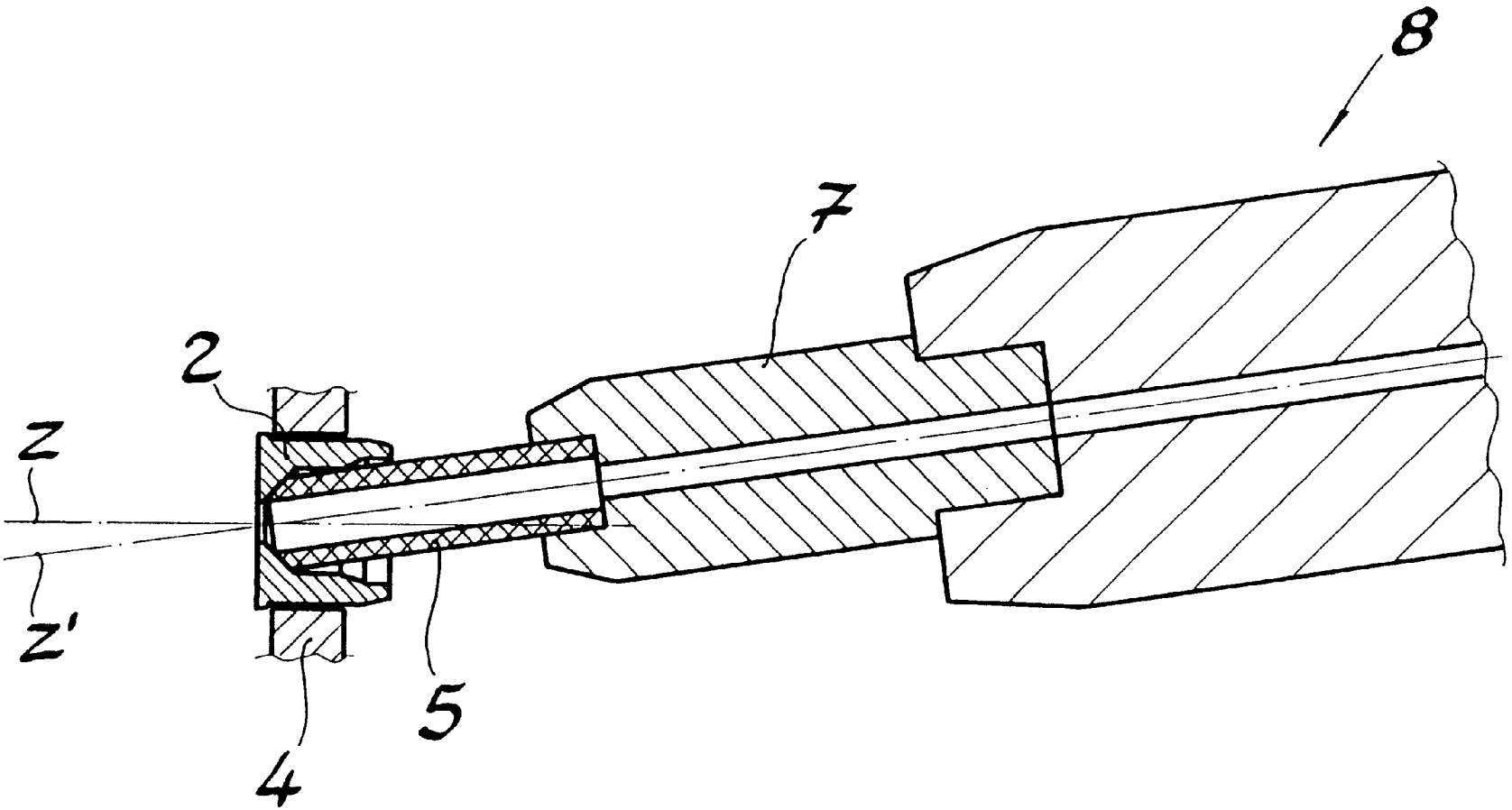
FIG. 2 shows a tool system for finishing the valve seat of the sealing system of FIG. 1.

FIG. 2 shows the tool arrangement for the finishing treatment of the valve seat. The workpiece 2 is chucked in a tool holder 4 that can be driven in a rotating manner; the chucking clamps are indicated only schematically. Workpiece 2 and a finishing tool 5 are driven to rotate in an opposite direction. In this process, the axes of rotation Z, Z' of workpiece 2 and finishing tool 5, are aligned in relation to each other at an angle of from 1° to 10°. In the course of the finishing treatment, finishing tool 5, is applied against the inner surface of the workpiece 2 over the entire circumference, and is inserted in a tool holder 7 that compensates alignment errors between workpiece 2 and finishing tool on stone 5. In the embodiment, shown, holder 7 is comprised of a shaft 7 made of hard rubber. It is understood that the tool system comprises a rotatably driven spindle 8 equipped with the usual devices for advancing and retracting movements.

Figure 3A:
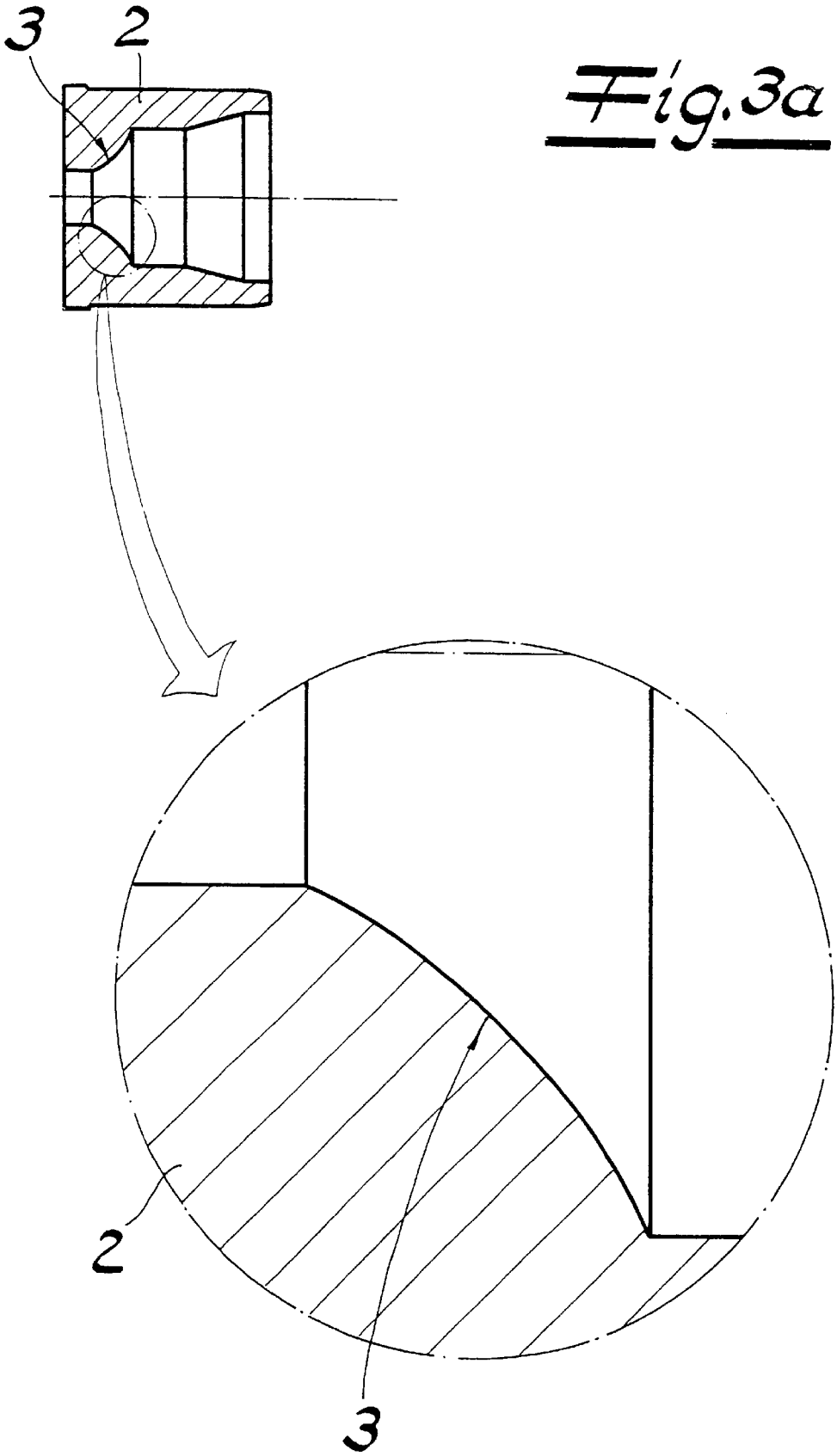
Figure 3C:
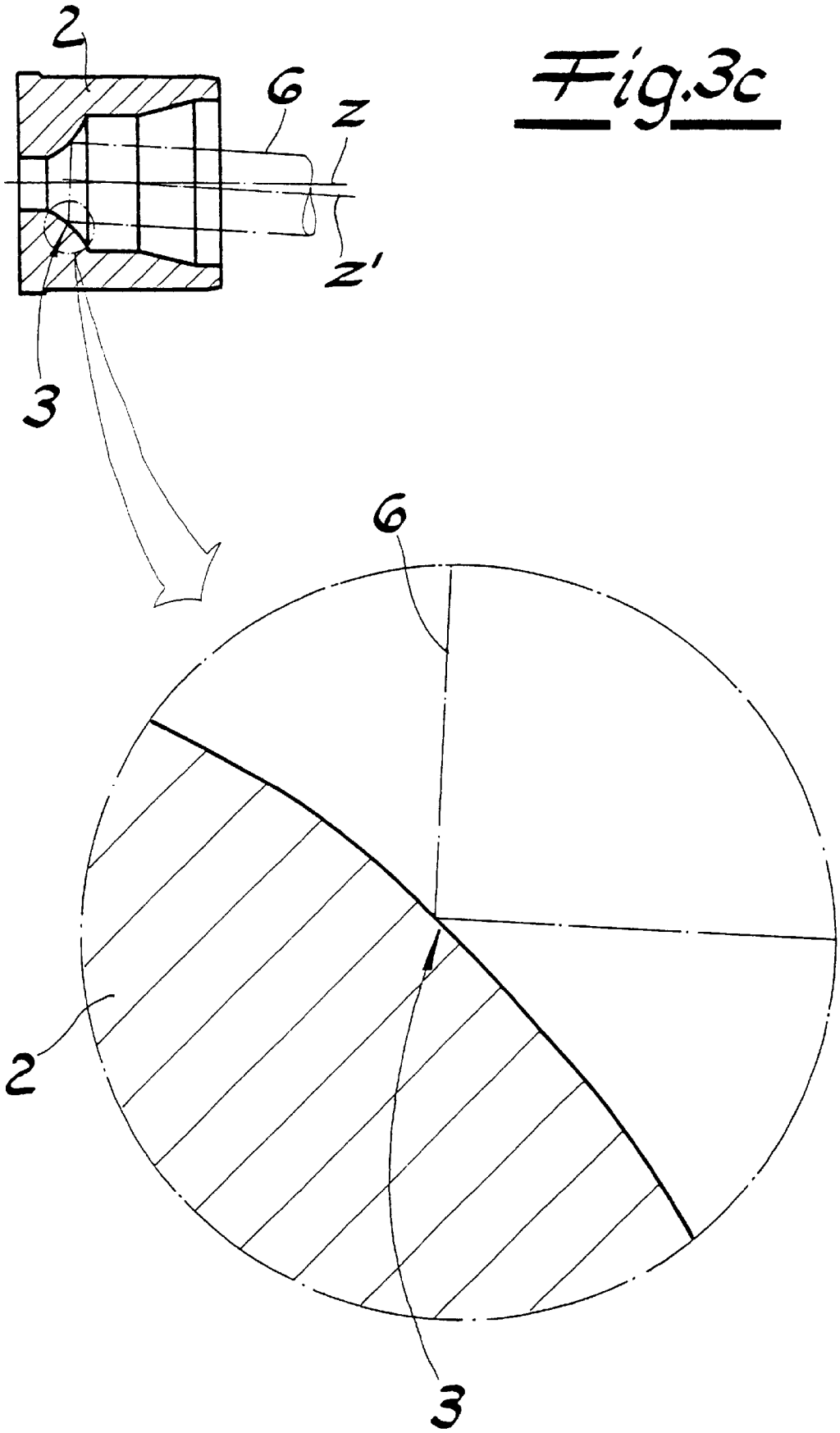

The sequence of the finishing treatment as defined by the invention is clearly obvious from a comparative view of FIGS. 3*a* to 3*c*. Workpiece 2 to be finished comprises a workpiece surface as valve seat 3 that has a crowned shape (FIG. 3*a*). Viewed in a cross sectional plane, crowned workpiece surface 3 shown in FIG. 3*a* still has interfering deviations from the circular shape. These deviations in the dimensions may amount to a few microns. A finishing stone with a hard, wear-resistant, cone-shaped working surface 9 is employed as finishing tool 5 or 6. A narrow sealing zone "a" with a convex profile (FIG. 3*b*) in the longitudinal section is produced in the crowned surface of the workpiece by partially removing some material. The aforementioned deviations in the form are eliminated by the finishing treatment shown in FIG. 3*b*.

In a subsequent step of the method, a seating surface "b" with a circular shape in the longitudinal section is worked into the already finished sealing zone "a" having a convex curvature. This seating surface "b" forms an improved sealing surface for valve ball 1. Workpiece 2 and a cylindrical finishing stone 6 are driven in an opposite direction of rotation in the finishing treatment of sealing seat "b", whereby the axes of rotation Z, Z' of workpiece 2 and finishing stone 6 are aligned at an angle of from 1° to 10° in relation to each other, and finishing stone 6 rests against sealing zone "a" over its entire circumference. Sealing seat 6 produced with this circular shape in the longitudinal section has a radius that is substantially larger than the radius of valve ball 1.

Figure 4A:
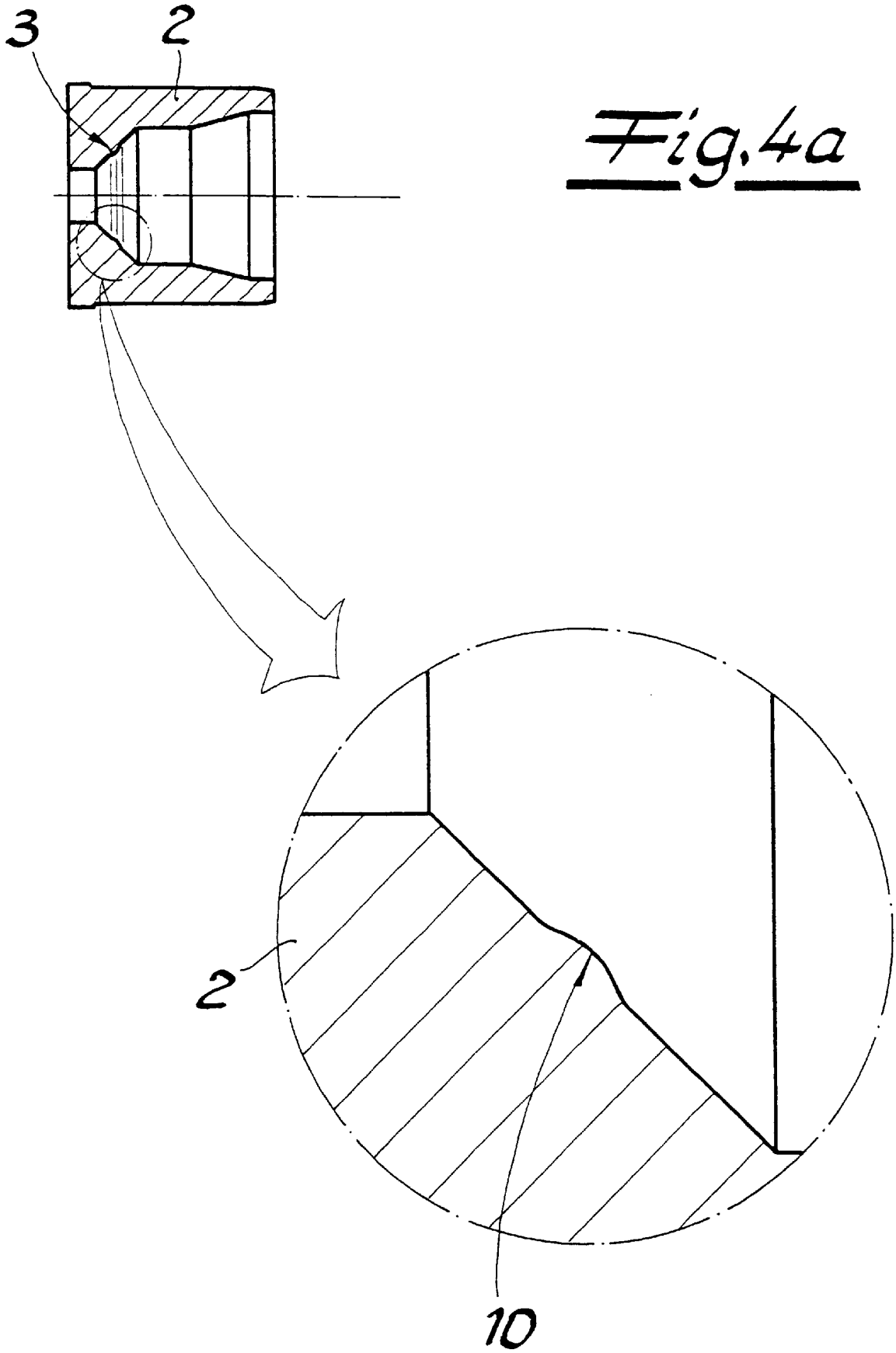
FIGS. 4*a* to 4*c* show another embodiment of the method as defined by the invention.
Figure 4B:
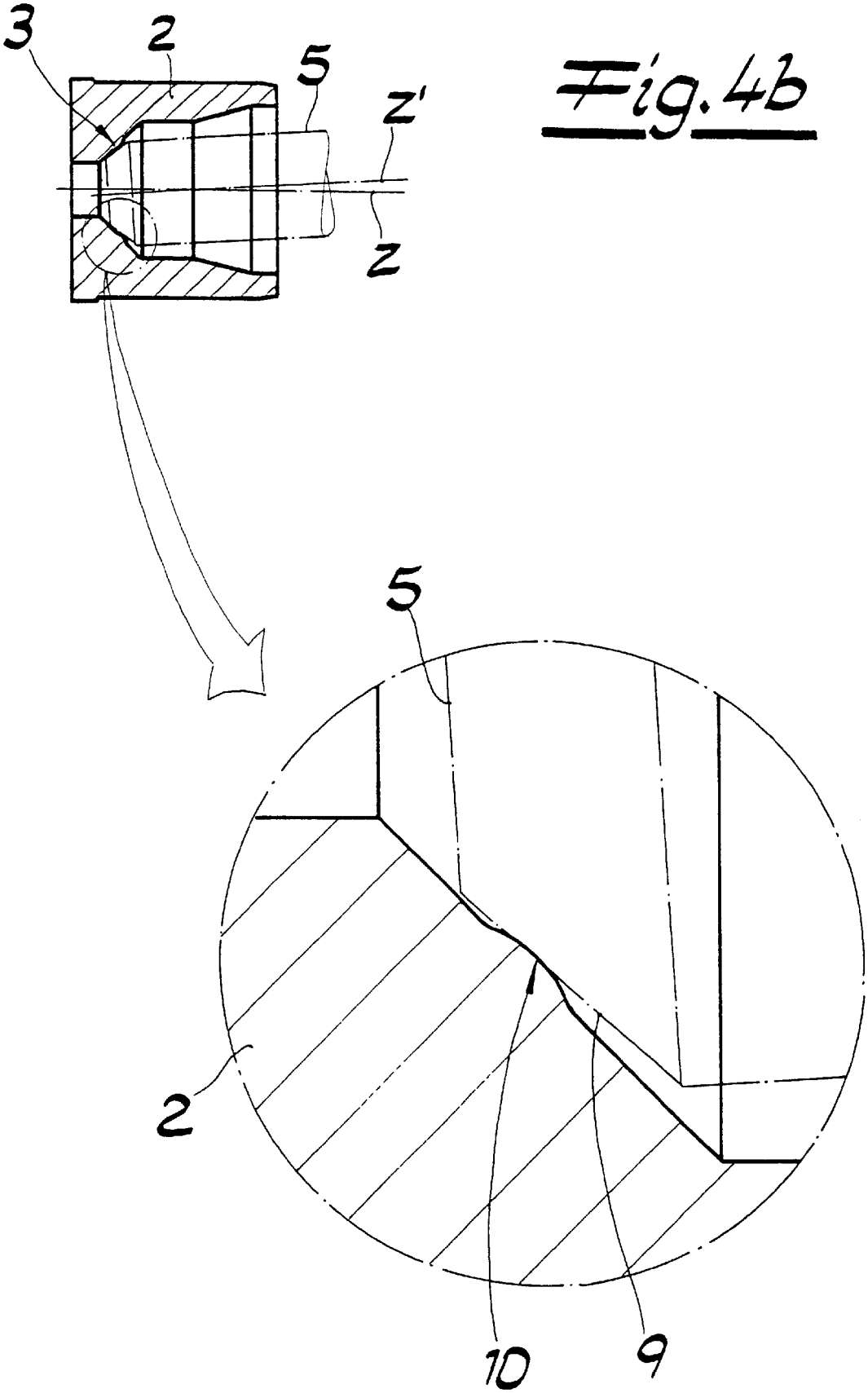
Figure 4C:
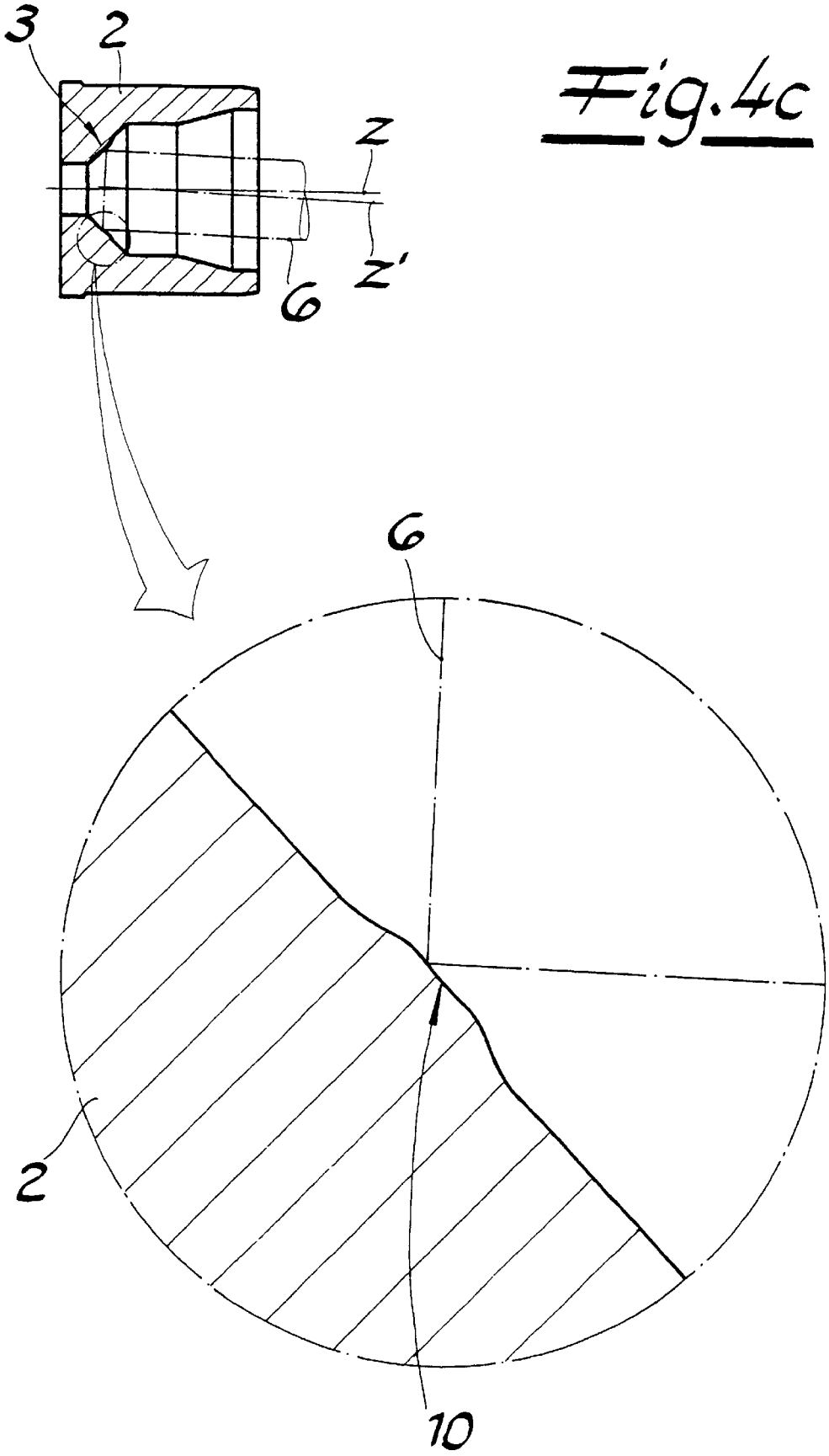

In the implementation of the method as defined by the invention shown in FIGS. 4*a* to 4*c*, valve 3 and thus the surface of the workpiece to be finished, has the shape of a cone, and only the crowned surface 10 of the sealing section protrudes inwardly. This crowned surface of the sealing section surface 10 is finished in the manner described above with the help of FIGS. 3*b* and 3*c*. The steps of the method are shown in FIGS. 4*b* and 4*c*.

While only a few embodiments of the present invention have been shown and described, it is to be understood that many changes and modifications may be made thereunto without departing from the spirit and scope of the invention as defined in the appended claims.

What is claimed is:

1. A method for finishing a valve seat for a ball valve comprising the steps of:

providing a finishing stone with a wear-resistant surface as a finishing tool;

providing a workpiece to be finished;

rotating said workpiece and said finishing tool in opposite directions with the axes of rotation of said workpiece and said finishing tool aligned with one another at an angle of between 1° to 10°;

applying said finishing tool against an inside surface of said workpiece over its entire circumference to provide said workpiece with a crowned surface; and partially removing material in said crowned surface of said workpiece to provide a narrow sealing zone with a convex contour in its longitudinal section.

2. The method according to claim 1, wherein said step of providing a finishing stone comprises providing a finishing stone with a conically shaped working surface.

3. The method according to claim 1, wherein said finishing stone or the workpiece are inserted in a holding means so as to compensate for errors in the alignment between the workpiece and the finishing stone.

4. The method according to claim 3, wherein the holding means comprises a shaft made of hard rubber.

5. The method according to claim 1, further comprising the step of working a seating surface comprising a circumferential ring having a circular shape in the longitudinal section into said narrow sealing zone.

6. The method according to claim 5, wherein said step of working a sealing surface comprises rotating the workpiece and a cylindrical finishing stone in opposite directions, whereby the axes of rotation of the workpiece and the finishing stone are aligned in relation to each other at an angle of between 1° to 10°, and the finishing stone rests against the entire circumference of the sealing zone.

7. The method according to claim 6, wherein the contact area of the cylindrical finishing stone on the face side is rounded in the form of a cup.

* * * * *